United States Patent [19]

Hanson

[11] Patent Number: 5,000,514

[45] Date of Patent: Mar. 19, 1991

[54] MINIATURE ROCKING CHAIR

[76] Inventor: Milo D. Hanson, P.O. Box 634, Gold Beach, Oreg. 97444

[21] Appl. No.: 514,399

[22] Filed: Apr. 26, 1990

[51] Int. Cl.[5] ..... A47C 7/00

[52] U.S. Cl. ..... 297/442; 297/443; 211/189; 108/111

[58] Field of Search ..... 297/440, 442, 443, 444, 297/258; 211/189; 108/111; 248/165

[56] References Cited

U.S. PATENT DOCUMENTS

| | | | |
|---|---|---|---|
| 2,486,987 | 11/1949 | Scarlett | 297/442 |
| 2,518,955 | 8/1950 | Stelzer | 297/442 |
| 2,546,811 | 3/1951 | Anderson | 297/440 |
| 3,466,092 | 9/1969 | Virany | 297/442 |
| 4,348,052 | 9/1982 | Roland | 297/440 |
| 4,509,794 | 4/1985 | Roland | 297/442 |
| 4,593,950 | 6/1986 | Infanti | 297/130 |

*Primary Examiner*—Kenneth J. Dorner
*Assistant Examiner*—James M. Gardner
*Attorney, Agent, or Firm*—John F. Ingman

[57] ABSTRACT

A miniature rocking chair is composed of five separate, generally planar, interlocking members: two identical side members, a back member having a rear seat support transversely formed thereon, a seat member, and a front seat support and locking member. The back member is attached to the two side members by upward facing openings on its side edges engaging downward facing openings on the back edge of the side members. The seat member is connected to the side members through rearward facing openings which engage a forward facing opening in each side member, the rear edge of the seat member occupying a position atop the rear seat support member. The front seat support and locking member then is inserted within the forward facing opening of the side members, beneath the seat member, to a position where openings formed in its bottom edge are aligned with notches formed in the lower edge of the forward facing opening of the seat member. The front seat support and locking member then is axially rotated ninety degrees so that its openings and the notches become engaged and its upper edge presses against the lower face of the seat member, forming a front transverse seat support, while the seat member is forced against a rearward location on the side member's forward opening, thereby locking both the seat member against the side members and the rear of the seat member on top of the rear seat support, the latter serving to lock the back member onto the side members.

5 Claims, 3 Drawing Sheets

MINIATURE ROCKING CHAIR

BACKGROUND OF THE INVENTION

1. Field of the Invention

This invention involves a miniature rocking chair, and, in particular, a miniature rocking chair for flower pots, dolls and the like, which is formed of generally planar interlocking members requiring no fasteners for assembly.

2. Description of the Prior Art

Rocking chairs have previously been developed which may be disassembled for storage or transportation. Such rocking chairs normally utilize threaded fasteners, dowels, or wedges to maintain the chair in assembled configuration. U.S. Pat. Nos. 4,348,052; 4,419,028; and 4,509,794; all issued to Billy F. Roland, present a knock down chair and a joint for assembly thereof.

In addition to full size rocking chairs for conventional sedentary human occupation, there are uses for a miniature rocking chair, namely as a chair for dolls and the like, and as a decorative holder for flower pots. There is a need, with such miniature rocking chairs, to be able to simply and inexpensively construct the chair from planar members so that it interlocks together without the use of fasteners, and readily may be assembled for use and disassembled for storage or transportation, as desired.

SUMMARY OF THE INVENTION

The present invention provides a miniature rocking chair which meets the aforementioned need. The miniature rocking chair includes five separate, generally planar, interlocking members.

Accordingly the miniature rocking chair in its preferred embodiment includes two identical side members, a back member having a rear seat support member transversely formed thereon, a seat member, and a front seat support and locking member. The seat member may have either a solid seat, appropriate for use with dolls and the like, or a seat with a circular opening for the receipt of conventional flower pots.

A first joining means, for connecting the back member to the two side members, includes the side member having a plurality of back member engaging openings proximate its back edge which are formed to face upwards, and a back member having a plurality of side member engaging openings located on or near its side edges, which face downwards. The upwardly facing openings of the side member and the downward facing openings of the back member are formed to be mutually engageable by downward movement of the back member relative to the side members. In an alternative form of the first joining means, the side members each have a lower back engaging opening which is formed to additionally include a pointed protrusion extending inwards within the opening from the upper back edge of the opening; and the back member additionally includes a dimple formed in its rear surface which engages such protrusion.

A second joining means is used for connecting the seat member to the side members, which additionally positions the seat member adjacent to the rear seat support member so that the seat member locks the back member to the side members by denying it upward movement relative to the side members. The second joining means includes each side member having a seat member engaging opening on its front edge which faces frontwards and extends backwards, and the seat member having a pair of side member engaging openings located at its rear edge, formed inwardly from each of its side edges. The frontward facing openings of the side members and the rearward facing openings of the seat member are formed to be mutually engageable, there being sufficient depth to the combination of such openings to allow the rear edge of the seat member to proceed rearwards between the side members to a position adjacent to and atop the rear seat support member formed onto the back member.

A third joining means is used whereby the front seat support and locking member, by axial rotation, presses and locks the seat member against the side members and the rear seat support member, and additionally secures the front seat support and locking member beneath the seat member so as to provide front transverse support thereof. The third joining means includes the front seat support and locking member having a pair of side member engaging openings which are formed to face downwards and extend upwards from its bottom edge; and each side member having, along the lower edge of each of its forward facing seat member engaging openings, a downward extending notch. The notches within the lower edge of the frontward facing opening of the aide members and the downward facing openings of the front seat support and locking member are formed to be mutually engageable, wherein, the back member previously having been connected to the side members by the first joining means and the seat member previously having been connected to the side members by the second joining means, the front seat support and locking member then is inserted into the two frontward facing seat member engaging openings of the side members, beneath the previously engaged seat member, to a position where the notches are aligned with the openings in the front seat support and locking member. The front seat support and locking member then is axially rotated approximately ninety degrees so that the notches and openings become mutually engaged, whereat the upper edge of the front transverse seat support and locking member presses perpendicularly against the lower face of the seat member. The seat member thereby is forced against a rearward location of the upper edge of the forward facing opening of the side member, thereby locking the seat member against the side members and the top of the rear seat support member, and securing the front seat support and locking member beneath the seat member, so as to provide front transverse support to the seat member.

DESCRIPTION OF THE PREFERRED EMBODIMENT

Figure 1:
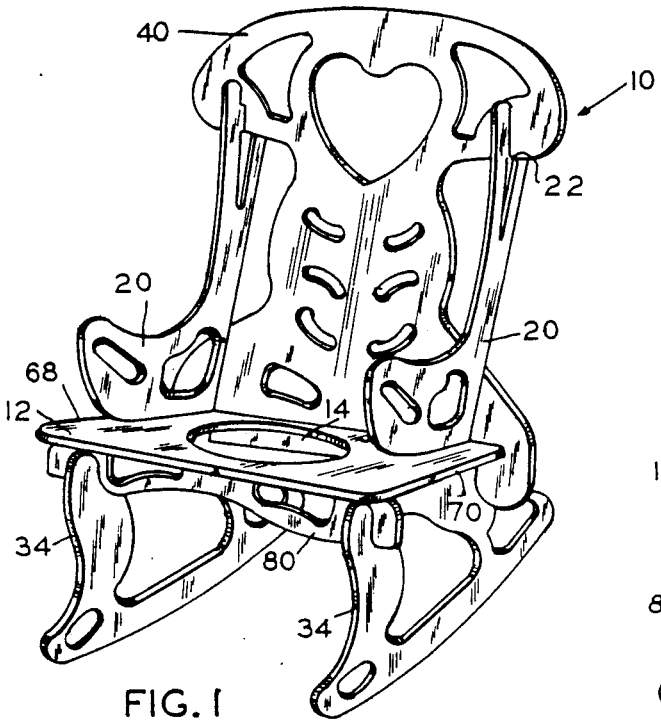
FIG. 1 illustrates a perspective view of the miniature rocking chair.
Figure 2:
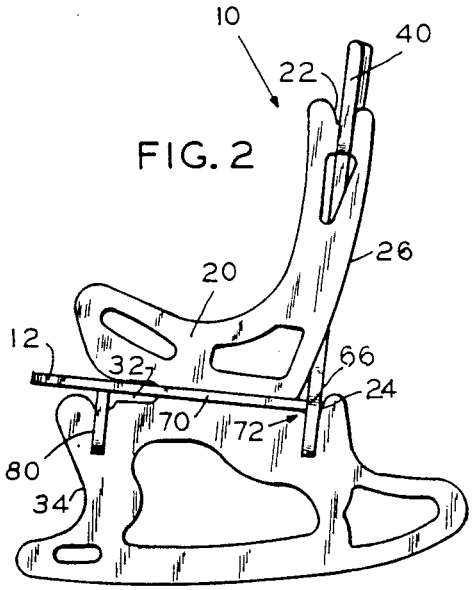
FIG. 2 illustrates a side elevation view thereof.
Figure 3:
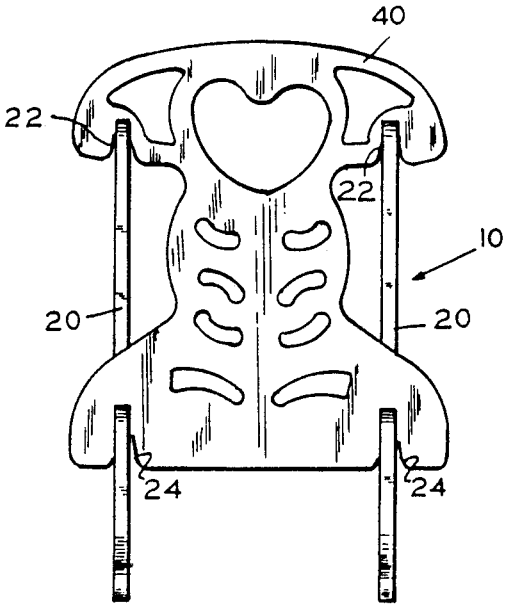
FIG. 3 illustrates a back elevation view thereof.
Figure 4:
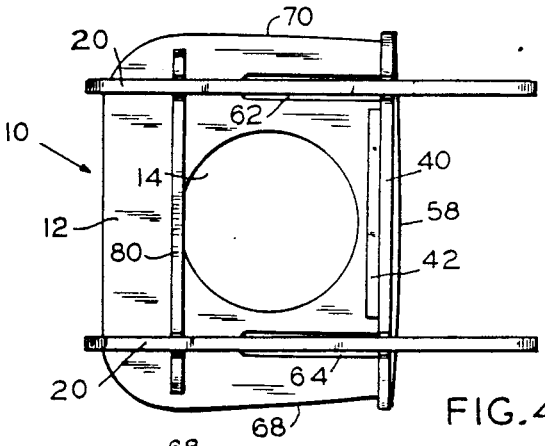
FIG. 4 illustrates a bottom view thereof.
Figure 5:
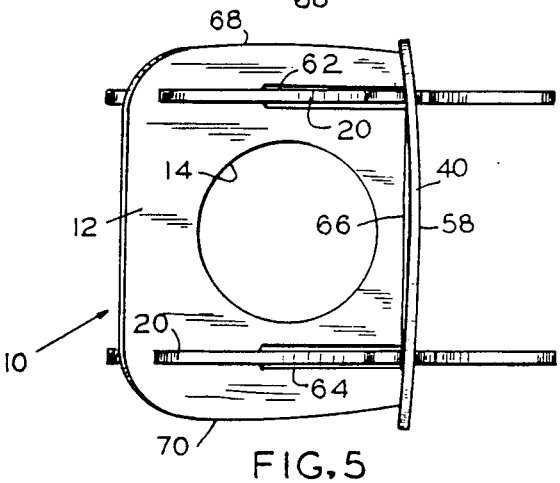
FIG. 5 illustrates a top view thereof.
Figure 6:
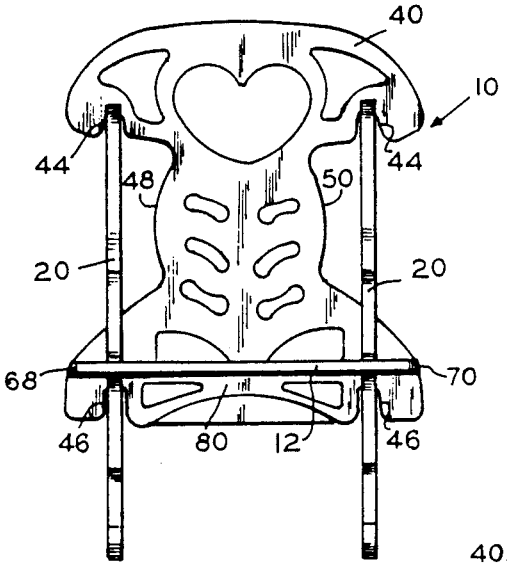
FIG. 6 illustrates a front view thereof.
Figure 7:
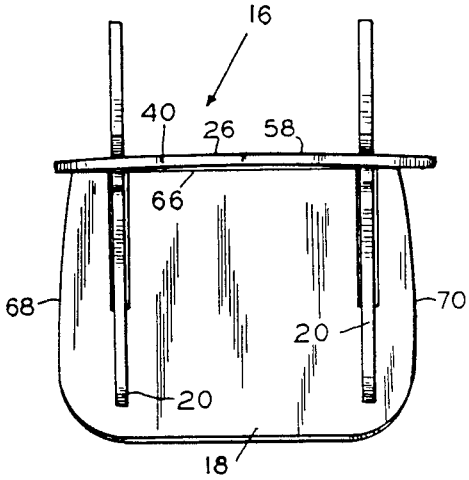
FIG. 7 illustrates a top view of an alternative configuration of the miniature rocking chair having a solid seat.

Turning now to the drawings, FIGS. 1 through 6 provide various views of the miniature rocking chair 10 of the invention, as assembled. The chair 10 in FIGS. 1 through 6 illustrate a seat member 12 which includes a circular opening 14 therein which may be used to hold a flower pot or similar container (not shown). An alternative miniature rocking chair configuration 16 includes an alternative seat member 18 which is solid; such alternative configuration 16 being usable as a chair for dolls (not shown) and the like. The alternative configuration 16 is shown only in FIG. 7 as a top view, such illustration serving to distinguish the difference between the two miniature rocking chairs 10 and 16.

Figure 8:
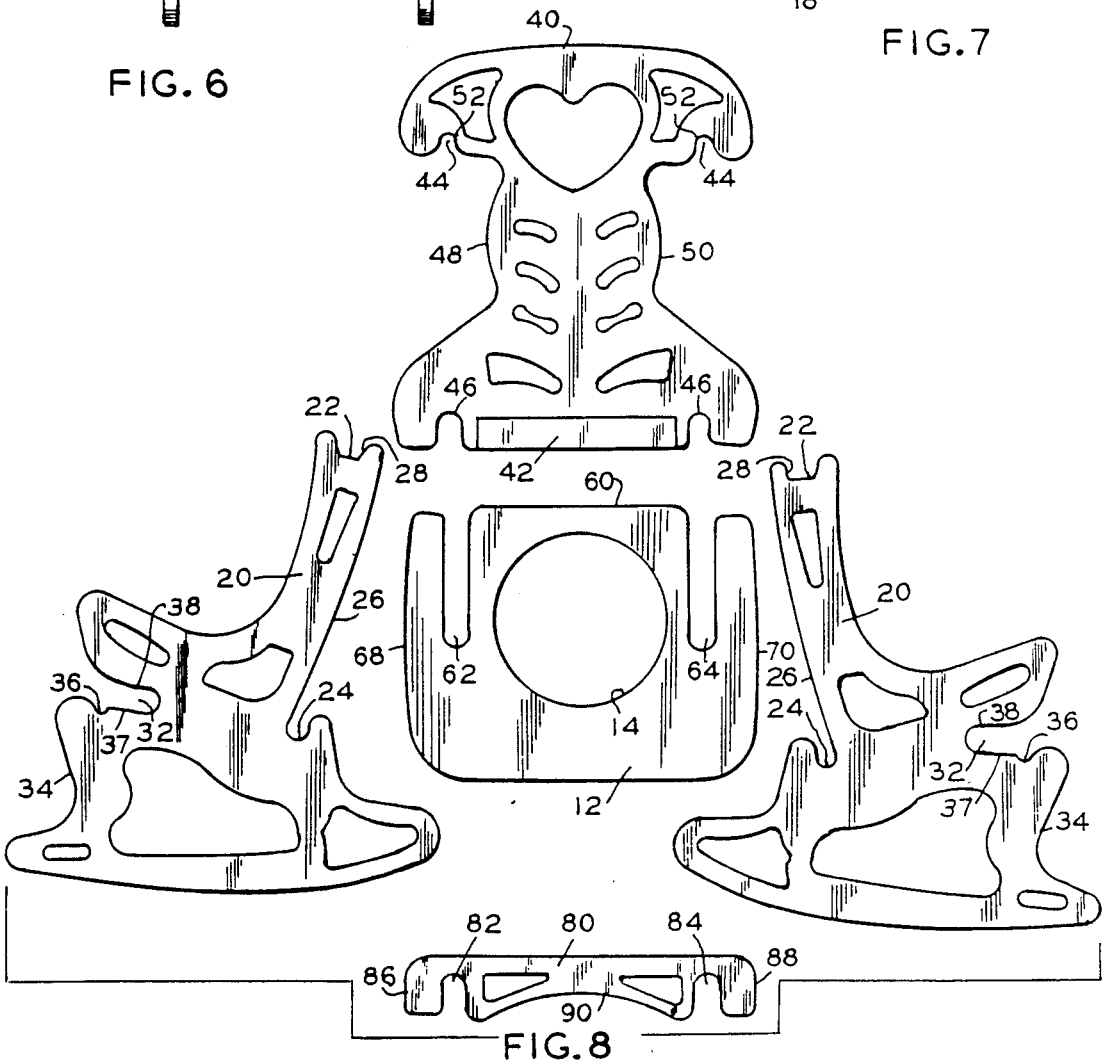
FIG. 8 illustrates the five component members of the miniature rocking chair of FIG. 1.
Figure 9:
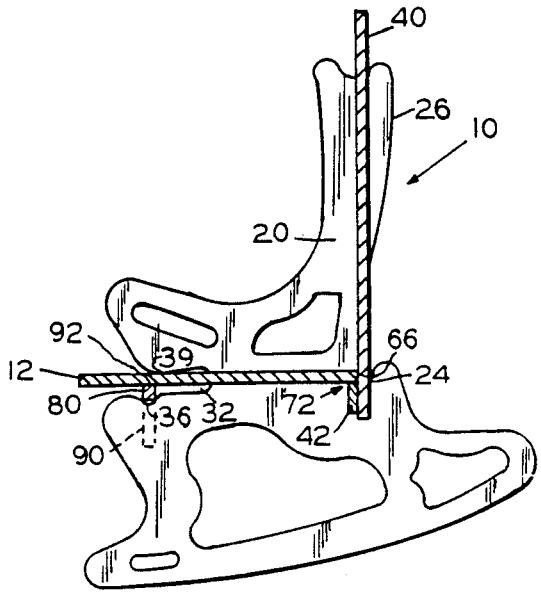
FIG. 9 illustrates a cross sectional view of the miniature rocking chair of FIG. 1.

FIG. 8 illustrates an exploded view of the five members of the miniature rocking chair 10. As shown, the chair 10 includes two identical side members 20, a back member 40 having a rear seat support member 42 transversely attached to or formed thereon, a seat member 12, and a front seat support and locking member 80. If the chair 10 is constructed with wood, a separate rear seat support member 42 may be attached, as by gluing; if constructed of plastic, it may be advantageous to add the rear seat support member 42 during the molding process of the back member 40.

The connection of the back member 40 to the side members 20 is achieved by (1) forming each of the the side members 20 with a plurality, preferably two, of back member engaging openings 22 and 24 which open at the back edge 26 and which face upwards and extend downwards, as illustrated; and (2) forming the back member 40 with a plurality, preferably two, side member engaging openings 44 and 46 on each of its two opposing side edges 48 and 50, the openings 44 and 46 being formed to face downwards and extend upwards. The upwardly facing openings 22 and 24 of the side members 20 and the downwardly facing openings 44 and 46 of the back member 40 are formed and spaced to be mutually engageable when the back member 40 and side members 20 are moved together, with the back member 40 approaching from the top and the side member 20 from beneath. The openings 22 and 44 may be formed so that fully contacting inner edges 28 and 52 will force a slight attractive curvature 58 in the back member 40, as illustrated in the drawings. Such curvature 58 is not a necessary element, however, in the interlocking of the back member 40 to the side members 20.

Figure 13:
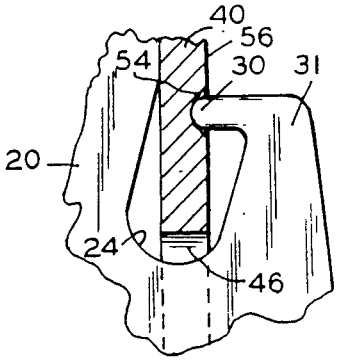
FIG. 13 illustrates portions of a side member and the back member showing an alternative first joining means.

In an alternative form of the first joining means, the side members 20 each have a lower back engaging opening 24 which is formed to additionally include a pointed protrusion 30 extending inwards within the opening from its upper back edge 31. The back member 40 includes, in such alternative form, a dimple 54 formed into its rear surface 56 which engages such protrusion. This alternative form of the first joining means is illustrated at FIG. 13, and may be desirable, particulatly when the chair 10 is formed of smooth, hard plastic.

A second joining means is utilized for connecting the seat member 12 to the side members 20, which additionally results in the locking of the back member 40 to the side members 20. Each side member 20 is formed with a seat member engaging opening 32 which is located facing the front edge 34 and extending rearwards. Each seat member 12 is formed with a pair of opposed side member engaging openings 62 and 64 at its rear edge 66, inward from each of its side edges 68 and 70. The seat member engaging openings 32 of the side members 20 and the seat member openings 62 and 64 are formed and spaced to be mutually engageable, there being sufficient depth to the combination of the openings 62 and 64 with openings 32, to allow the rear edge 66 of the seat member 12 to proceed rearwards between the side members 20 to a position 72 adjacent to, and atop the transversely-oriented rear seat support member 42 on the back member 40. Such location of the rear edge 66 of the seat member 12 above and against the rear seat support member 42 both provides rear support for the seat member 12 and locks the back member 40 into its engaged position with the side members 20 by preventing disengagement of the openings 22 and 24 from openings 48 and 50, respectively. The width 35 of the openings 32 of the side members 20 must be sufficient to allow the insertion of both the seat member 20 and the front seat support and locking member 80, as will be subsequently more fully appreciated.

A third joining means is used to connect the front seat support and locking member 80 within the chair 10 and thus both lock the seat member 12 into position against the side members 20 and the rear seat support member 42, and provide, beneath the seat member 12, front transverse support. The front seat support and locking member 80 is formed to have a pair of side member engaging openings 82 and 84, proximate to its two opposing side edges 86 and 88, which open and face downwards and extend upwards from its bottom edge 90. Each side member 20 is formed to have, on the lower edge 37 of its forward facing openings 32, a downward extending notch 36.

Figure 10:
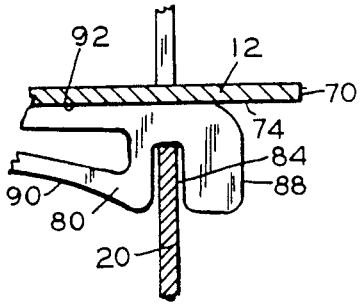
FIG. 10 illustrates an enlarged front view of the engagement of the front seat support and locking member, the seat member and a side member of the miniature rocking chair.
Figure 11:
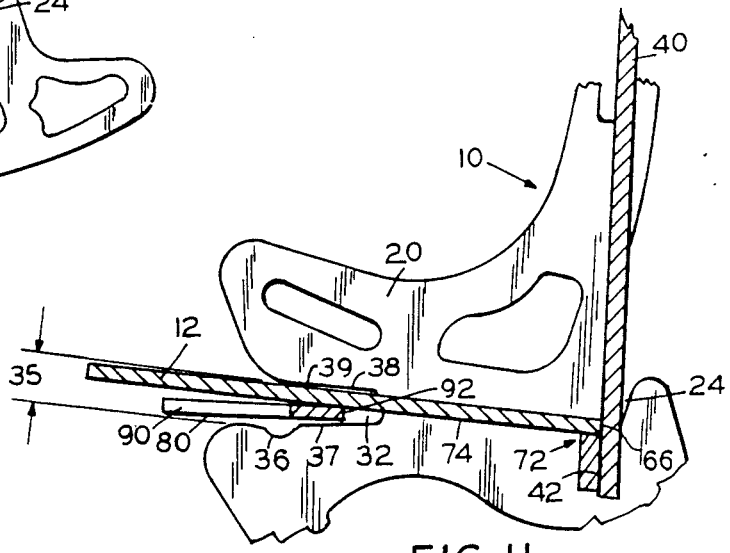
FIG. 11 illustrates an enlarged partial cross sectional view, showing the insertion of the front support and locking member prior to axial rotation.
Figure 12:
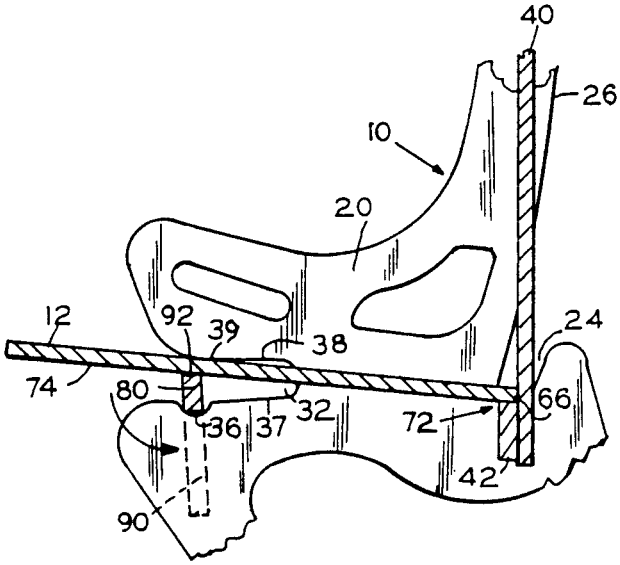
FIG. 12 illustrates an enlarged partial cross sectional view, where axial rotation of the front transverse support and locking member has occurred.

In the assembly of the chair 10, before utilization of the front seat support and locking member 80, the back member 40 and seat member 12 have been connected to the side members 20, as described above. The notches 36 on the lower edge 37 o( the frontward facing opening 32 and the downward facing openings 82 and 84 of the front transverse seat support and locking member 80, are formed to be mutually engageable following the insertion of the front seat support and locking member 80, into the forward facing side member openings 32 beneath the previously engaged seat member 12, to a position where the notch 36 is aligned with the openings 82 and 84, as shown in FIG. 10. The front seat support and locking member 80 is then axially rotated approximately ninety degrees, as is shown in FIG. 11, so that the notches 36 and openings 82 and 84 became mutually engaged. When so engaged, the upper edge 92 of the front seat support and locking member 80 presses perpendicularly against the lower face 74 of the seat member 12 which, in turn, is forced against a rearward location 39 on the upper edge 38 of the forward facing opening 32. The rotational engagement thereby secures the front seat support and locking member 80 beneath the seat member 12, providing front transverse support to the seat member 12, and locks the seat member 12 against the side members 20 and the rear seat support member 42.

Upon the locking of the front seat support and locking member 80 into place, the miniature rocking chair 10 is completely assembled and its members 12, 20, 40, and 80 interlocked into their positions. Disassembly is the reverse of the above described procedure for assembly.

It is thought that the miniature rocking chair of the present invention and its many attendant advantages will be understood from the foregoing description and that it will be apparent that various changes may be made in form, construction and arrangement of the parts thereof without departing from the spirit and scope of the invention or sacrificing all of its material advantages, the forms hereinbefore stated being merely exemplary embodiments thereof.

I claim:

1. A miniature chair, comprising:

a. two identical planar side members, a first side member and a second side member;

b. a planar back member having a rear seat support member transversely formed thereon;

c. a planar seat member;

d. a planar front seat support and locking member;

e. a first joining means for connecting the back member to the first and second side members;

f. a second joining means for connecting the seat member to the first and second side members, the second joining means additionally positioning the seat member adjacent to the rear seat support member so that the seat member locks the back member to the first and second side members; and g. a third joining means on the front seat support and locking member, by axially rotating, pressing and locking the seat member against the side members and the rear seat support member, and additionally securing the front seat support and locking member beneath the seat member so as to provide front transverse support thereof.

2. The miniature chair, as recited in claim 1, wherein the first joining means for connecting the back member to the first and second side members includes:

a. the side member, having a front edge and a back edge, includes a plurality of back member engaging openings located proximate the back edge and formed to face upwards;

b. a back member having two opposing side edges, includes a plurality of side member engaging openings located proximate each of the two opposing side edges and formed to face downwards; and c. the upwardly facing back member engaging openings of the side member and the downward facing side member engaging openings of the back member being formed to be mutually engageable.

3. The miniature chair, as recited in claim 2, wherein at least one back member engaging opening of the seat member additionally includes a pointed protrusion extending inwards within said opening; and the back member additionally includes a dimple formed within a surface, which dimple engages said protrusion.

4. The miniature chair, as recited in claim 1, wherein the second joining means for connecting the seat member to the first and second side members includes:

a. each side member, having a front edge and a rear edge, includes a seat member engaging opening located on the front edge and formed to face frontwards and extend rearwards;

b. each seat member, having opposing side edges, a front edge and a rear edge, includes a pair of opposed side member engaging openings located at the rear edge and formed inward from each of the opposed side edges;

c. the frontward facing, seat member engaging, openings of the side members and the rearward facing side member engaging openings of the seat member being formed to be mutually engageable, there being sufficient depth in said engagement of the openings to allow the rear edge of the seat member to occupy a position adjacent to and atop the rear seat support member formed onto the back member.

5. The miniature chair, as recited in claim 4, wherein the third joining means, whereby the front seat support and locking member, by axial rotation, presses and locks the seat member against the side members and the rear sear support member, and additionally secures the front seat support and locking member beneath the seat member so as to provide front transverse support thereof, includes:

a. the front seat support and locking member, having a top edge, a bottom edge and two opposing side edges, includes a pair of side member engaging openings proximate each of the two opposing side edges and formed to face downwards and extend upwards from the bottom edge;

b. each side member having a seat member engaging opening having a lower edge and an upper edge, said seat engaging opening of the side members having on its lower edge a downward extending, upwardly facing notch;

c. the back member previously having been connected to the first and second side members by the first joining means and the seat member previously having been connected to the first and second side members by the second joining means;

d. the downwardly extending, upwardly facing notches within the lower edge of the seat member engaging opening of the side members and the downward facing side member engaging openings of the front seat support and locking member being formed to be mutually engageable by means of insertion of the front seat support and locking member into the seat member engaging opening of the side member and beneath the previously engaged seat member, to a position where the notch is proximate the openings in the front seat support and locking member, whereat the front seat support and locking member is axially rotated approximately ninety degrees so that the notches and openings become mutually engaged, and the upper edge of the front seat support and locking member presses perpendicularly against the seat member, forcing the seat member against the upper edge of the seat engaging opening of the side member at a rearward position thereof, thereby locking the seat member against the side members and the top of the rear seat support member, and securing the front seat support and locking member beneath the seat member, thereby additionally providing front transverse support to the seat member.

* * * * *